US006412317B1

(12) United States Patent
Martin

(10) Patent No.: US 6,412,317 B1
(45) Date of Patent: Jul. 2, 2002

(54) INTEGRATED CABINET DOOR AND DRAWER HANDLE AND LOCK

(75) Inventor: Frank J. Martin, Seattle, WA (US)

(73) Assignee: Olympus Lock, Inc., Seattle, WA (US)

( * ) Notice: Subject to any disclaimer, the term of this patent is extended or adjusted under 35 U.S.C. 154(b) by 0 days.

(21) Appl. No.: 09/702,368

(22) Filed: Oct. 30, 2000

(51) Int. Cl.[7] ..... E05B 65/46

(52) U.S. Cl. ..... 70/81; 70/86; 70/207; 70/370; 70/451; 312/348.6

(58) Field of Search ..... 70/78–86, 95–100, 70/370, DIG. 31, 466, 207, 450, 451; 292/DIG. 53; 312/330.1, 348.6, 348.4

(56) References Cited

U.S. PATENT DOCUMENTS

| | | | | | |
|---|---|---|---|---|---|
| 963,451 | A | * | 7/1910 | Lowe | 70/452 |
| 2,666,319 | A | * | 1/1954 | Price | 70/97 |
| 3,095,227 | A | * | 6/1963 | Casebolt | 70/100 |
| 3,368,374 | A | * | 2/1968 | Eads | 70/370 |
| 4,790,157 | A | * | 12/1988 | Lin | 70/100 X |
| 5,046,340 | A | * | 9/1991 | Weinerman et al. | 70/208 |
| 5,121,619 | A | | 6/1992 | Martin | 70/371 |
| 5,340,174 | A | * | 8/1994 | Bender et al. | 292/347 X |
| 5,369,969 | A | * | 12/1994 | Sassella et al. | 70/90 |
| 5,606,880 | A | * | 3/1997 | Viggiano | 70/370 X |
| 5,657,652 | A | | 8/1997 | Martin | 70/85 |
| 6,059,329 | A | * | 5/2000 | Spitzley | 292/DIG. 53 X |

OTHER PUBLICATIONS

Author unknown, "Don–Jo Mfg., Inc. Complete Product Line Door and Lock Security Solutions", 1994, Don–Jo Mfg., Inc., Sterling, MA.

Author unknown, catalog pp. 3 and 4 "Pre–Assembled Unit Locksets UT5200 Series", published prior to the filing date of application; Corbin Russwin, location unknown.

Author unknown, "UT5200 Series Unit Lock Template", May 23,1993; Corbin Russwin, location unknown.

* cited by examiner

*Primary Examiner*—Lloyd A. Gail
(74) *Attorney, Agent, or Firm*—Richardson & Folise

(57) ABSTRACT

An integrated cabinet door and drawer handle and lock provides a front piece having apertures for receipt of a cabinet door or drawer lock and a human hand. Optionally, a wire pull handle can be provided. A backing plate having a transverse lip thereon is adapted for telescoping interaction with the front piece. A cabinet door or drawer having a portion cut out therefrom for receipt of the integrated handle and lock is clamped between the front piece and backing plate such as by screws. Multiple locks can be incorporated into the integrated structure.

14 Claims, 4 Drawing Sheets

INTEGRATED CABINET DOOR AND DRAWER HANDLE AND LOCK

TECHNICAL FIELD

The invention relates to cabinet door and drawer handles and locks. More specifically, the invention relates to handles and locks for use with particle board cabinet doors and drawers.

BACKGROUND OF THE INVENTION

A wide variety of cabinet door and drawer locks are currently available in this well developed art. U.S. Pat. No. 5,121,619 to Martin entitled "Speed Release Mechanism for Cylinder and Plug Assembly for Use with Cabinet Locks" issued Jun. 16, 1992, and assigned to the assignee of the present invention illustrates one example of an advanced cabinet door and drawer lock. Locks of this type typically have a substantially rectangular bolt housing in which resides a retractable deadbolt. A cylinder and plug assembly conventionally resides in a cylindrical cylinder and plug assembly housing which itself extends forwardly from the bolt housing. The bolt housing is typically mounted to the back side of a cabinet door or drawer by screws or the like, while the cylinder and plug assembly housing protrudes through a circular aperture in the cabinet door or drawer. The bolt is retracted or extended by inserting a key into the cylinder and plug assembly and rotating the key. A strike plate may be provided on the opposing cabinet door or adjacent drawer jamb in the case of a cabinet drawer.

Deadlocking latch-locks suitable for use in cabinet door and drawer applications are also known, and a lock of this type is disclosed in U.S. Pat. No. 5,657,652 entitled "Pin Tumbler Cabinet Door and Drawer Deadlocking Latch-lock" issued on Aug. 19, 1997, also assigned to the assignee of the present invention. In that patented design, the external configuration of the lock is substantially identical to that shown with respect to the deadbolt style cabinet door and drawer lock. However, the bolt of the deadlocking latch-lock is split into a main bolt having a curved surface and an adjacent deadlocking bolt also having a similarly curved profile. This structure permits the lock to be "latched" into place merely by closing the cabinet door or drawer. If the deadlocking bolt portion remains depressed by the adjacent jamb portion of the structure to be locked, then the main bolt remains locked in an extended position until retracted by operation of a key. Thus, in this type of lock a key is not required to close the door or drawer having the deadlocking latch-lock.

Considering the highly developed state of the prior art, additional advances in cabinet door and drawer lock technology have typically been driven by changes in structure external to the lock itself. For example, solid wood has become increasingly scarce as a raw material for cabinetry. Due to the increasing cost of such virgin raw materials, combination fiber board in the form of wood fibers embedded in a plastic resin have replaced sheets or panels of solid wood. For aesthetic purposes, this type of "press board" is typically faced on one or both sides with a plastic laminate or veneer. Unfortunately, composite structures of this type have far lower tensile strength than the hard woods such as oak and the semi-hard woods such as spruce, fir and fruit woods which were previously employed in cabinet structures. Thus, a need exists for a cabinet door and drawer lock which can accommodate the lower tensile strength and screw retention capabilities of composite "press board" cabinet doors and drawers.

In addition, the recent adoption of the Americans With Disabilities Act (hereinafter "ADA") has also necessitated changes with respect to handle and door pull designs for cabinet doors and drawers. When applied to composite "press board" cabinet doors and drawers, such handles suffer from the same screw retention and force concentration problems associated with prior art cabinet door and drawer locks mounted on press board surfaces. Thus, a need exists for a cabinet door and drawer handle and pull which is adaptable to composite wood structures.

SUMMARY OF THE INVENTION

It is therefore an object of the present invention to provide a cabinet door and drawer lock which can accommodate the lower tensile strength and screw retention capabilities of composite "press board" cabinet doors and drawers.

It is a further object of the invention to achieve the above object with a cabinet door and drawer handle and pull which is adaptable to composite wood structures.

The invention achieves these objects, and other objects and advantages which will become apparent from the description which follows, by providing an integrated cabinet door and drawer handle and lock for receipt in a cutaway portion of a cabinet door or drawer manufactured from a composite wood fiber/resin material. In the preferred embodiment, the integrated cabinet door and drawer handle and lock has a front piece consisting of a main body portion and a substantially planar face plate portion defining a cylinder housing aperture for receiving the cylinder housing portion of a cabinet door and drawer lock, and a handle aperture for receiving a user's fingers when used as a cabinet door or drawer pull. The face plate portion has at least three laterally extending flanges and a rearwardly-directed, transversely extending lip portion positioned on an edge of the face plate portion and spaced apart from the main body portion. The preferred embodiment also includes a substantially planar backing plate which when used in conjunction with the front piece clamps the lock onto a cutout portion of a composite cabinet door or drawer. The backing plate preferably has a transversely extending lip portion corresponding to the lip portion on the front piece, so that the respective lip portions engage one another in a telescoping, sliding relationship. In this way, different thicknesses of composite cabinet door and drawer materials can be accommodated while the flanges on the front piece and the backing plate essentially clamp the portions of the cabinet door or drawer adjacent to the main body portion so as to spread out forces transferred from the integrated handle and lock to the entire adjacent surface of the cabinet door or drawer. This structure avoids the concentration of forces on screw holes in the composite material typically relied on for mounting prior art locks.

In the preferred embodiment, the handle aperture in the face plate is narrower than the corresponding handle aperture in the main body portion so as to define a hidden pull surface for the user's fingers behind the face plate. In an alternate embodiment of the invention, the main body and face plate portions of the front piece further define a second cylinder housing aperture for receipt of a cylinder housing portion of a second cabinet door and drawer lock which can be of the latch-lock type.

The integrated cabinet door and drawer handle and lock optionally includes a wire pull handle connected to the front piece. The wire pull handle has a substantially straight portion suspended in a spaced apart relationship from the handle aperture on the front piece. The wire pull handle can be laterally positioned either adjacent to the handle aperture or directly above the handle aperture.

In yet another alternate embodiment of the invention, the structure of the integrated cabinet door and drawer handle and lock can be provided without any aperture for cabinet door or drawer locks, and without the optional wire pull handle to present a "dummy" handle used in door and drawer applications.

DETAILED DESCRIPTION OF THE PREFERRED EMBODIMENTS

Figure 1:
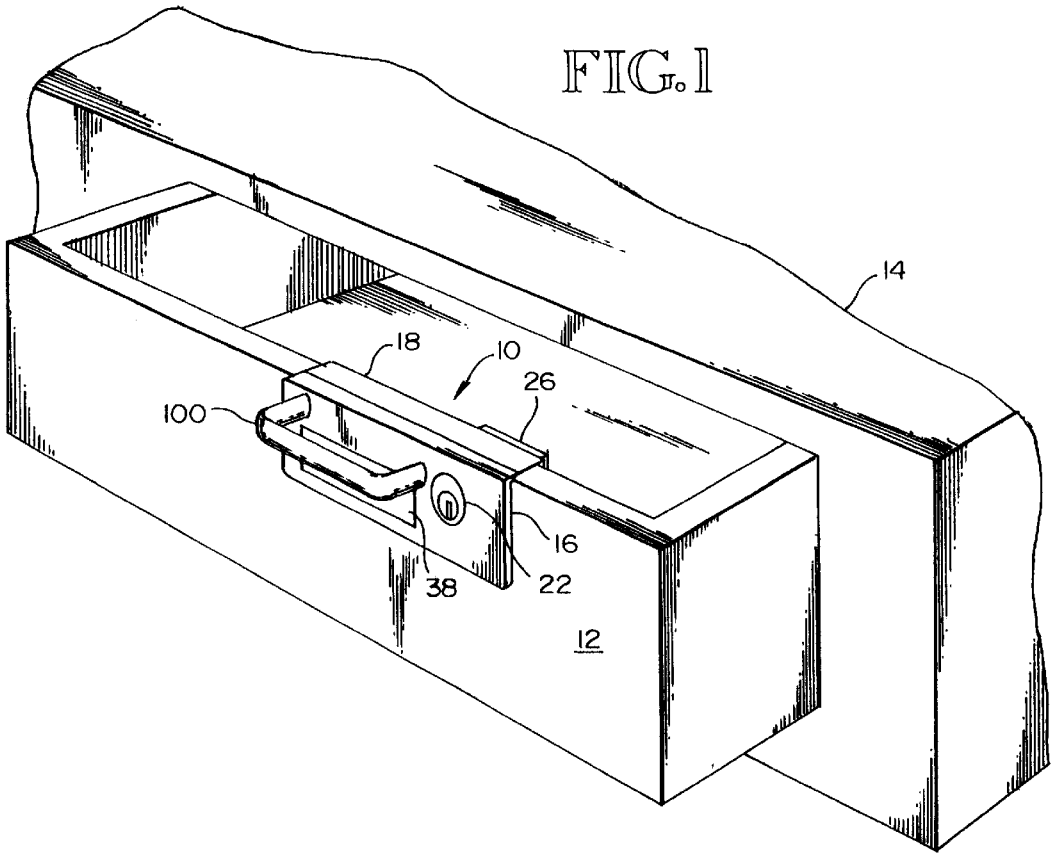
FIG. 1 is an environmental, perspective view of an integrated cabinet door and drawer handle and lock of the present invention applied to a cabinet drawer.
Figure 2:
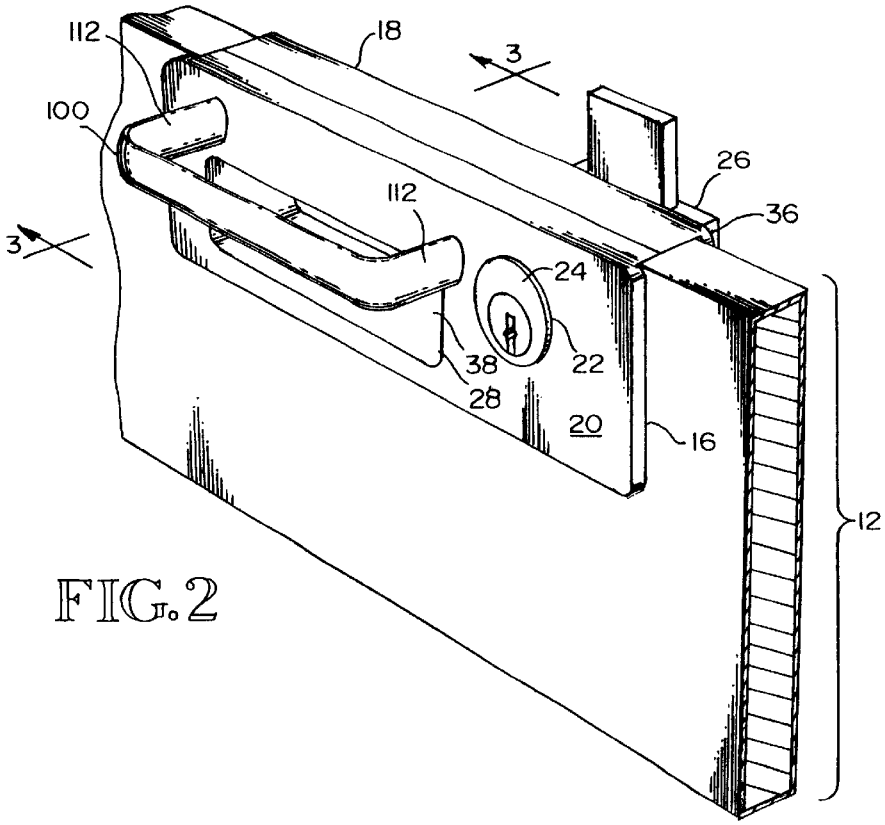
FIG. 2 is an enlarged, perspective view of the cabinet door and drawer handle and lock shown in FIG. 1.

An integrated cabinet door and drawer handle and lock, in accordance with the principles of the present invention, is generally indicated at reference numeral 10 in FIG. 1. The integrated handle and lock 10 is shown applied to a drawer 12 of an exemplary cabinet 14, such as a counter at a bank teller window or the like.

The preferred embodiment of the invention shown in FIG. 1 includes a front piece 16 adapted for telescoping interconnection with a backing plate 18. The front piece 16 has a face plate portion 20 defining a circular cylinder and plug assembly aperture 22 for receiving a cylinder and plug assembly portion 24 of a conventional deadlocking cabinet door and drawer lock 26. A suitable cabinet door and drawer lock is described in U.S. Pat. No. 5,121,619 to Martin entitled "Speed Release Mechanism for Cylinder and Plug Assembly for Use with Cabinet Locks" issued Jun. 16, 1992, the disclosure of which is incorporated herein by reference. The face plate portion 20 also defines an elongated, rectangular handle aperture 28 for receipt of a user's fingers (not shown) for pulling open the drawer 12, as will be described further hereinbelow.

Figure 3:
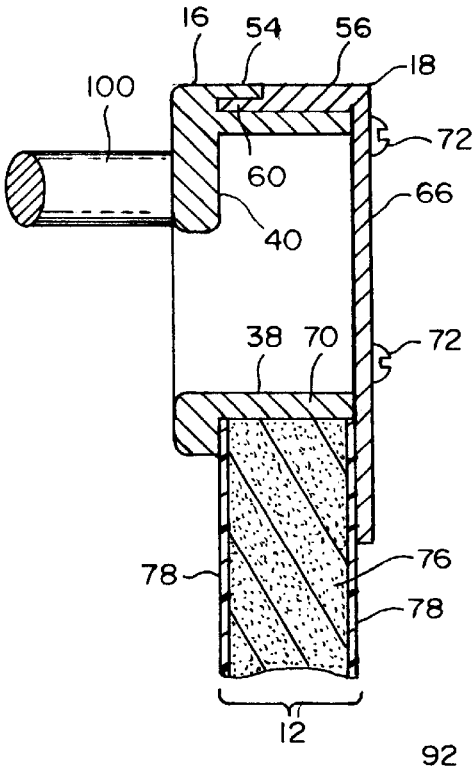
FIG. 3 is a cross-sectional view taken along line 3—3 of FIG. 2.
Figure 4:
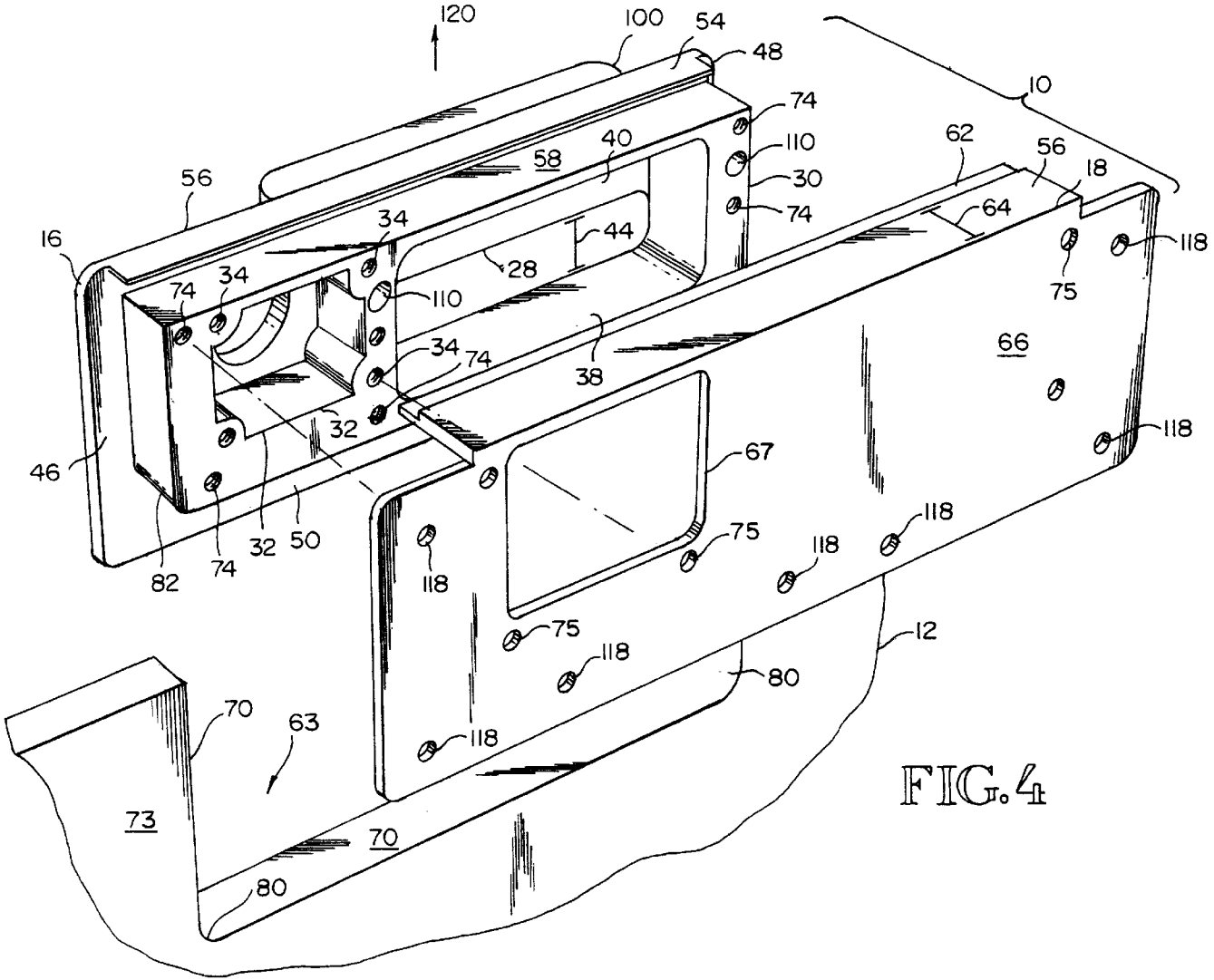
FIG. 4 is an exploded, rear isometric view of a front piece and backing plate of the invention removed from an exemplary cabinet drawer or door.

As seen in FIGS. 3 and 4, the face plate 20 generally defines a substantially planar surface and reference plane from which extends in a transverse and rearwardly direction a main body portion 30. The main body portion defines a cavity for a main body portion cylinder housing aperture 32 which corresponds to and is in registration with the face plate cylinder and plug aperture 22 for receiving the conventional cabinet door and drawer lock 26. Threaded screw holes 34 are provided for mounting a bolt housing portion 36 of the deadlocking cabinet door and drawer lock 26 to the main body portion 30. In addition, the main body portion 30 defines a main body handle aperture 38 which corresponds to, is aligned with, and is in registration with the face plate handle aperture 28. Both the main body and face plate handle apertures 28, 38 have a preferred length of approximately 3.670 inch. The main body handle aperture has a preferred height or width of approximately 1.397 inch. However, the face plate handle aperture 28 has a preferred height or width of only 0.870 inch providing a pull surface 40, shown in FIG. 4, having a width of approximately one-half inch for a user's fingers. This difference between the width of the main body handle aperture 38 and face plate handle aperture 28 leaves a void generally indicated at reference numeral 44 of approximately 0.870 inch. The face plate 16 preferably has a thickness of approximately 0.210 inch, while the main body portion 30 typically has a depth of approximately 0.750 inch such that the entire depth of the face plate and main body handle apertures is approximately 0.960 inch.

The face plate portion 20 further defines left, right and bottom flanges 46, 48 and 50, respectively, which extend laterally from and with respect to the main body portion 30. Each flange extends laterally approximately 0.025 inch from the main body portion 30. An upper portion 52 of the face plate portion 20, best seen in FIGS. 3 and 4, is provided with a rearwardly directed, transverse lip 54 for mating with a corresponding lip 56 on the backing plate 18. The lip 54 on the face plate portion 20 extends rearwardly approximately 0.125 inch and is spaced away from an upper sidewall 58 of the main body portion 30 a distance of approximately 0.063 inch, so as to form a pocket 60 having a depth of approximately 0.125 inch for telescopically receiving a reduced thickness portion 62 of the lip 56 on the backing plate 18. The lip 56 has a main portion 64 having a depth of approximately 0.500 inch, while the reduced thickness portion 62 has a depth of approximately 0.125 inch so as to reside within the pocket 60 in a telescoping manner. Thus, as shown in FIG. 4 the backing plate 18 and front piece 16 can accommodate drawers 12 and/or cabinet doors having a thickness ranging from approximately 0.875 inch to approximately 1.000 inch.

The backing plate 18 is provided with a main plate portion 66 substantially transverse to the lip 56. The main plate portion 66 is at least longitudinally and laterally coextensive with the face plate portion 20 of the front piece 16. The main plate portion also defines an aperture 67 for receipt of the cabinet drawer lock 26. Furthermore, the flanges 46, 48 and 50 on the face plate portion 20 laterally extend from the main body portion 30 of the front piece 16 a distance of at least 0.25 inch. Thus, by providing the cabinet drawer 12 with a cutout generally indicated at reference numeral 68 defining cutout sidewalls 70 having dimensions selected to closely approximate corresponding dimensions of the main body portion 30 of the front piece 16, the flanges 46, 48 and 50 can clamp the integrated cabinet door and drawer handle and lock 10 to adjacent surfaces of the cabinet drawer 12 when the front piece 16 and backing plate 18 are assembled together with screws 72 or the like as seen in FIG. 3. The screws 72 are received in corresponding, threaded screw holes 74 in the main body portion 30. The main plate portion 66 is further provided with screw holes 75 for passage therethrough of shanks of the screws 72.

As will be apparent to those of ordinary skill in the art, the integrated cabinet door and drawer handle and lock 10 advantageously distributes tensile loads across a broad surface area of the cabinet drawer 12. As best seen in FIG. 3, modern cabinetry often employs composite wood structures consisting of a wood fiber/polymer resin matrix core 76 veneered with thermoplastic surfaces 78, commonly sold under the Formica name. Structures of this type cannot withstand concentrated tensile loads as high as those which can be withstood by hardwoods such as oak and medium soft woods such as fir, spruce, and fruit woods. In addition, cabinet door and drawer manufacturers have the option of merely providing the cabinet door or drawer 12 with the appropriate cutout 68 at the factory without having to install the cabinet door/drawer locks and pull hardware at the factory. Rather, the manufacturer can merely ship the cabinetry with the cutout 68 and the purchaser of the cabinetry can install the inventive integrated cabinet drawer and door handle and lock 10 on site without having to modify the cabinetry itself. Finally, those of ordinary skill in the art will appreciate that thermoplastic laminate surfaces 78 cannot be cut at 90° angles or chipping will result. Thus, both the particle board core 76 and the laminate surface 78 are typically radiused at corners 80 to maintain warranties on these products. The main body portion 30 preferably also has corresponding corners 82 having a radius of approximately 0.250 inch to closely match the shape of the corners 80 in the cabinet doors/drawers 12. In this manner, tensile loads are evenly distributed throughout all points of contact between the integrated cabinet door and drawer handle and lock 10 and adjacent surfaces of the cabinet door or drawer 12 without concentrating stresses or tensile loads at any point in the surrounding structure.

Figure 5:
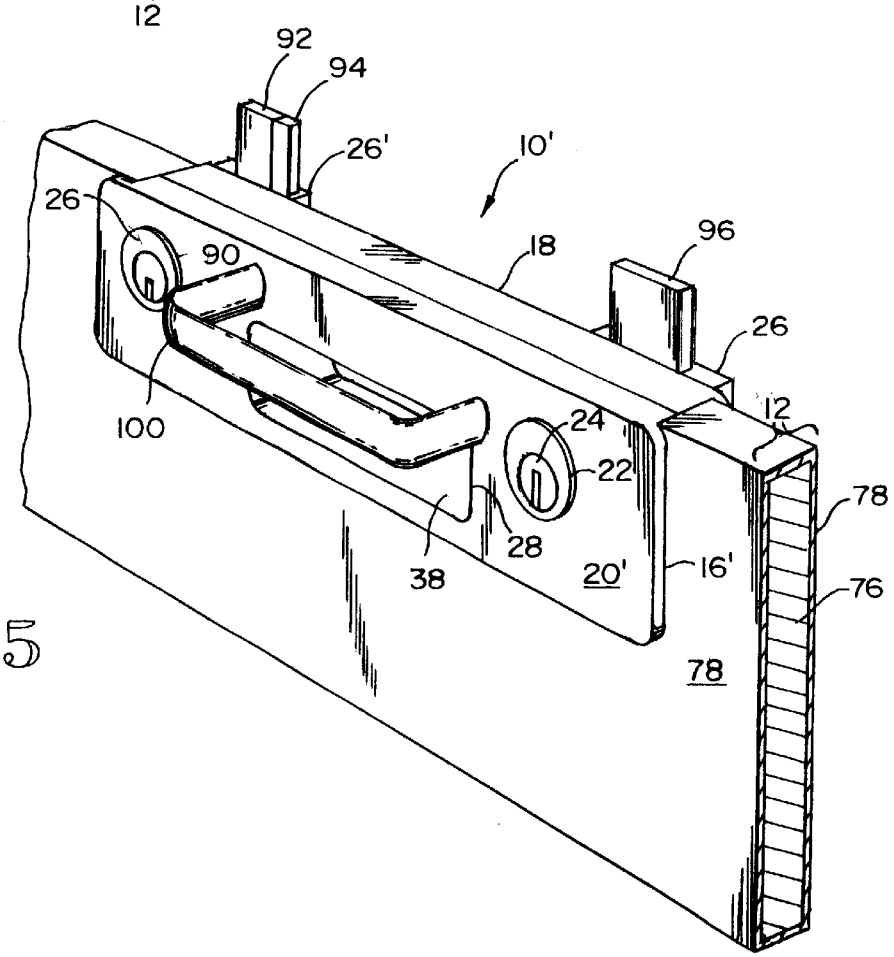
FIG. 5 is a isometric, environmental view of an alternate embodiment of the invention employing both a standard deadlocking cabinet drawer lock as well as a deadlocking latch-lock in an integrated cabinet door and drawer handle end lock.

An alternate embodiment of the invention is generally indicated at reference numeral 10' in FIG. 5. In this alternate embodiment like reference numerals refer to correspondingly numbered structures of the preferred embodiment 10 shown in FIGS. 1 through 4. This alternate embodiment 10' includes a second cylinder and plug assembly aperture 90 for receiving a cylinder and plug assembly 22' of a second cabinet drawer and door lock 26'. However, in this alternate embodiment, the preferred cabinet door and drawer lock 26' is of the deadlocking latch-lock variety shown and described in U.S. Pat. No. 5,657,652 to Martin entitled "Pin Tumbler Cabinet Door and Drawer Deadlocking Latch-lock" is sued on Aug. 19, 1997, the disclosure of which is incorporated herein by this reference. This type of lock includes a main bolt 92, having a curved rear surface, and an adjacent deadlocking bolt 94, also having a curved rear surface. As will be appreciated by those of ordinary skill in the art, the conventional deadlocking cabinet door and drawer lock 26 has a main bolt 96 which can only be actuated by operation of a key to the retracted to extended positions or vice versa. In contrast, the deadlocking latch-lock 26' can retract both its main and deadlocking bolts 92, 94, merely by closing the drawer 12 against a strike plate (not shown) on the adjacent cabinet structure. Only at that point is a key necessary to retract the main bolt 92 to reopen the drawer 12. Thus, the alternate embodiment of the integrated cabinet door and drawer handle and lock 10' shown in FIG. 5 has significant utility where two different individuals, each having differing security clearances, require access to the drawer 12. For example, in a casino environment the dealer can be provided with a key which only actuates the deadlocking latch-lock 26' so that he or she can close and lock the drawer 12 whenever away from the gaming table without using a key. However, the pit boss can be provided with a different key for actuating the deadlocking cabinet door and drawer lock 26 (the lock shown on the right hand side of FIG. 5) which will exclude access to the drawer 12, even to the dealer.

In both the preferred and alternate embodiments of the invention, the integrated cabinet door and drawer handle and lock 10 and 10' can be provided with a wire pull handle 100 to meet requirements of the Americans With Disability Act (hereinafter "ADA"). As best seen in FIG. 4, the main body portion 30 of the front piece 16 is provided with bores for receipt of hex head bolts (not shown) for securing the handle 100 to both the preferred and alternate embodiments 10 and 10'. In the conventional manner, the handle 100 has leg portions 112 which permit the handle to stand off from the face plate portion 20. Although the handle 100 is shown laterally displaced with respect to the face plate handle aperture 28, the handle 100 and bores 110 may alternately be repositioned so as to place the handle 100 directly above the handle aperture 28.

Figure 6:
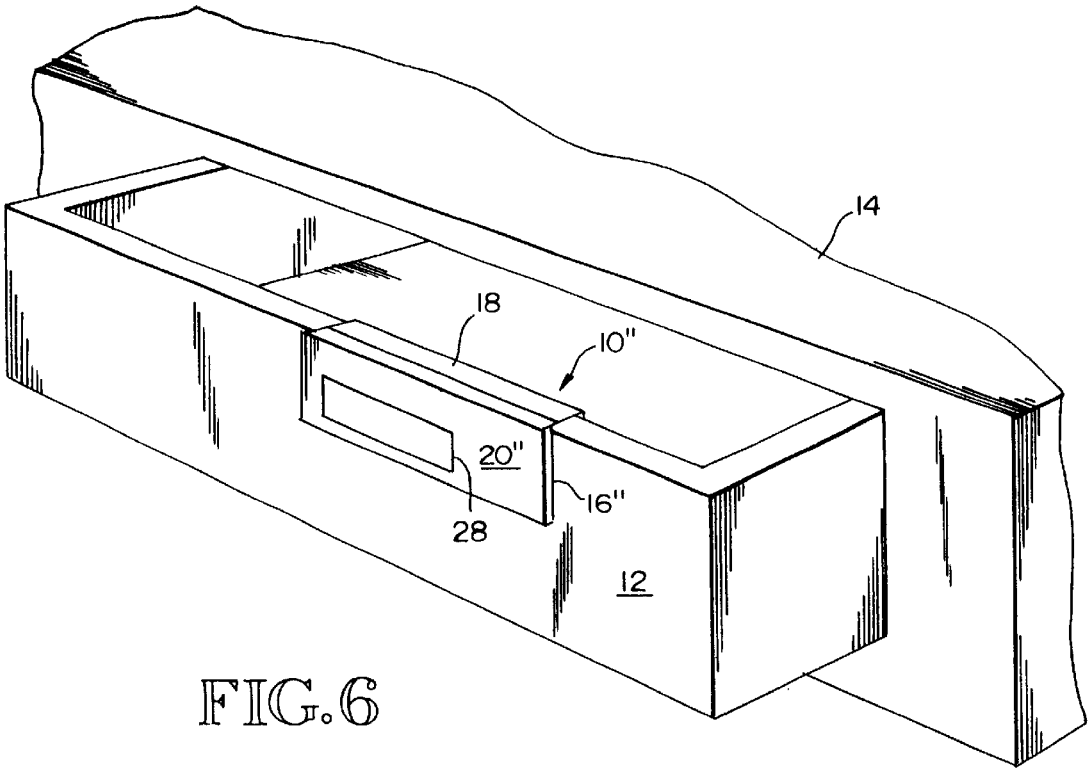
FIG. 6 is a second alternate embodiment of the invention employed as a cabinet door and drawer handle alone.

An additional alternate embodiment of the invention is generally indicated at 10" in FIG. 5 In this embodiment, the front piece 16" does not have any cylinder and plug assembly apertures in the face plate portion 20". Thus, when mated with the backing plate 18 in the manner shown in FIG. 6 the alternate embodiment 10" serves as a "dummy handle" for use on a cabinet door or drawer where a lock is not required, or for aesthetic symmetry when used on cabinets having two adjacent, open doors.

Alternate embodiments of the above disclosed embodiments of the invention are contemplated. For example, all of the embodiments shown on the figures are shown in so-called "left hand" versions when applied to cabinet doors. Obviously, the lateral orientation of the handle apertures 28, 38 can be repositioned with respect to the front piece 16 to render a "right hand" version. Furthermore, any of the lock embodiments 10, 10' and 10" may be further secured to the door on drawer 12 of the cabinet 14 by additional screws (not shown) inserted through securing screw holes 118 to resist movement of the lock 10, 10' and 10" in the direction of arrow 120 in FIG. 4. Thus, the invention is not to be limited by the above disclosure, but is to be determined in scope by the claims which follow.

I claim:

1. An integrated cabinet door and drawer handle and lock for receipt in a cut away portion of a cabinet door or drawer, comprising:

a main body portion having sidewalls defining a cylinder housing aperture and an elongated handle aperture;

a substantially planar face plate portion connected to the main body portion defining a cylinder housing aperture corresponding to and in registration with the main body portion cylinder housing aperture for receipt therethrough of a cylinder housing portion of a cabinet door and drawer lock, the face plate portion further defining a handle aperture corresponding to and in registration with the main body portion handle aperture for receipt therethrough of a user's fingers, wherein the face plate portion has at least three flanges laterally extending from the main body portion and a rearwardly directed, transversely extending lip portion positioned on an edge of the face plate portion and spaced apart from the main body portion;

a substantially planar backing plate for clamping union with the main body and face plate portions, wherein the backing plate has on one edge thereof a forwardly directed, transversely extending lip portion corresponding to and positioned for telescoping, sliding registration with the face plate portion lip portion; and, means for drawing the main body and face plate portions towards the backing plate in a clamping relationship so that the main body portion can be positioned in a cut away portion of a cabinet door or drawer whereby the flanges and the backing plate clamp against portions of the cabinet door or drawer adjacent to the main body portion.

2. The integrated cabinet door and drawer handle and lock of claim 1, wherein main body and face plate portions are integral with one another.

3. The integrated cabinet door and drawer handle and lock of claim 1, wherein the face plate portion handle aperture is substantially narrower than the main body portion handle aperture so as to define a pull surface for the user's fingers.

4. The integrated cabinet door and drawer handle and lock of claim 1, wherein the main body and face plate portions each further define second cylinder housing apertures corresponding to and in registration with one another for receipt therethrough of a cylinder housing portion of a second cabinet door and drawer lock.

5. The integrated cabinet door and drawer handle and lock of claim 4, wherein the second cabinet door and drawer lock is a deadlocking latch lock.

6. The integrated cabinet door and drawer handle and lock of claim 1, wherein the main body portion has at least two substantially radiused corners to reduce mechanical stresses on the cabinet door or drawer when the lock is pulled by the user's fingers.

7. The integrated cabinet door and drawer handle and lock of claim 1, wherein the lock includes a wire pull handle connected to the face plate and main body portions, the wire pull handle having a substantially straight portion suspended in a spaced apart relationship with the handle apertures.

8. An integrated cabinet door and drawer handle and lock, comprising:

a front piece having a main body portion and a substantially planar face plate portion defining a cylinder housing aperture for receipt therethrough of a cylinder housing portion of a cabinet door and drawer lock, and a handle aperture for receipt therethrough of a user's fingers, wherein the face plate portion has at least three laterally extending flanges and a rearwardly directed, transversely extending lip portion positioned on an edge of the face plate portion and spaced apart from the main body portion; and, a substantially planar backing plate for clamping union with the front piece, wherein the backing plate has on one edge thereof a forwardly directed, transversely extending lip portion corresponding to and positioned for telescoping, sliding registration with the front piece lip portion, so that the front piece-and backing plate can be drawn together in a clamping relationship so that the main body portion can be positioned in a cut away portion of a cabinet door or drawer whereby the flanges and the backing plate clamp against portions of the cabinet door or drawer adjacent to the main body portion.

9. The integrated cabinet door and drawer handle and lock of claim 8, wherein the front piece further defines a second cylinder housing aperture for receipt therethrough of a cylinder housing portion of a second cabinet door and drawer lock.

10. The integrated cabinet door and drawer handle and lock of claim 9, wherein the second cabinet door and drawer lock is a deadlocking latch lock.

11. A cabinet door and drawer handle for receipt in a cut away portion of a cabinet door or drawer, comprising:

a main body portion having sidewalls defining an elongated handle aperture;

a substantially planar face plate portion connected to the main body portion defining a handle aperture corresponding to and in registration with the main body portion handle aperture for receipt therethrough of a user's fingers, wherein the face plate portion has at least three flanges laterally extending from the main body portion and a rearwardly directed, transversely extending lip portion positioned on an edge of the face plate portion and spaced apart from the main body portion;

a substantially planar backing plate for clamping union with the main body and face plate portions, wherein the backing plate has on one edge thereof a forwardly directed, transversely extending lip portion corresponding to and positioned for telescoping, sliding registration with the face plate portion lip portion; and, means for drawing the main body and face plate portions towards the backing plate in a clamping relationship so that the main body portion can be positioned in a cut away portion of a cabinet door or drawer whereby the flanges and the backing plate clamp against portions of the cabinet door or drawer adjacent to the main body portion.

12. The cabinet door and drawer handle of claim 11, wherein the face plate portion handle aperture is substantially narrower than the main body portion handle aperture so as to define a pull surface for the user's fingers.

13. The integrated cabinet door and drawer handle of claim 11, wherein main body and face plate portions are integral with one another.

14. The integrated cabinet door and drawer handle of claim 11, wherein the main body portion has at least two substantially radiused corners to reduce mechanical stresses on the cabinet door or drawer when the handle is pulled by the user's fingers.

* * * * *

UNITED STATES PATENT AND TRADEMARK OFFICE

CERTIFICATE OF CORRECTION

PATENT NO. : 6,412,317 B1
DATED : July 2, 2002
INVENTOR(S) : Frank J. Martin

It is certified that error appears in the above-identified patent and that said Letters Patent is hereby corrected as shown below:

Column 8,
Line 39, delete “integrated”.
Line 41, delete “integrated”.

Signed and Sealed this

Twenty-fourth Day of September, 2002

*Attest:*

*Attesting Officer*

JAMES E. ROGAN
*Director of the United States Patent and Trademark Office*